US005139374A

United States Patent [19]

Holt et al.

[11] Patent Number: 5,139,374

[45] Date of Patent: Aug. 18, 1992

[54] TRAILER SENSOR FOR RAILROAD HITCH

[75] Inventors: Jan D. Holt, St. Charles; Tom B. Baker, St. Peters, both of Mo.

[73] Assignee: ACF Industries, Inc., Earth City, Mo.

[21] Appl. No.: 650,420

[22] Filed: Feb. 4, 1991

[51] Int. Cl.[5] ..... F16B 9/00

[52] U.S. Cl. ..... 410/64; 410/58

[58] Field of Search ..... 410/56, 58, 59, 60, 410/61, 62, 63, 64

[56] References Cited

U.S. PATENT DOCUMENTS

| | | | |
|---|---|---|---|
| 3,337,170 | 8/1967 | Remy et al. | 410/61 |
| 3,346,223 | 10/1967 | Broling | 410/64 X |
| 3,358,954 | 12/1967 | Smith et al. | 410/59 |
| 3,434,683 | 3/1969 | Rollins | 410/59 X |
| 3,493,207 | 2/1970 | Feeris et al. | 410/62 X |
| 3,513,804 | 5/1970 | Yeates et al. | 410/64 |
| 3,632,145 | 1/1972 | Davis et al. | 410/64 |
| 4,407,617 | 10/1983 | Hammonds | 410/59 |
| 5,017,065 | 5/1991 | Krug et al. | 410/56 X |
| 5,026,229 | 6/1991 | Matyas et al. | 410/60 |

FOREIGN PATENT DOCUMENTS

| | | | |
|---|---|---|---|
| 617419 | 3/1961 | Canada | 410/59 |

*Primary Examiner*—Robert J. Spar
*Assistant Examiner*—Robert S. Katz
*Attorney, Agent, or Firm*—Polster, Lieder, Woodruff & Lucchesi

[57] ABSTRACT

A trailer sensor (83) for use on a retractable railcar trailer hitch (1) is disclosed. The hitch has a hitch head (3) for capturing a kingpin (K) of a trailer (T), a locking mechanism (35) for latching the hitch in its erect position, and a manually operable release mechanism (67) for retracting the hitch. A movable sensing element (85) carried on the hitch head senses the presence or absence of a trailer. A rod (93) moves the sensing element in response to operation of the release mechanism. If a trailer is supported by the hitch, the assembly blocks movement of the sensor and prevents retraction of the hitch. If no trailer is supported by the hitch, the sensing element allows the release mechanism to unlock the hitch so it can retract.

15 Claims, 4 Drawing Sheets

TRAILER SENSOR FOR RAILROAD HITCH

BACKGROUND OF THE INVENTION

This invention relates to a hitch for railroad cars such as an intermodal railcar (e.g., a piggy-back car) wherein the hitch supports an over-the-road trailer on the car with the hitch being movable between an erect position and a retracted position. Specifically, the hitch of this invention relates to a trailer sensor for sensing the presence or absence of a trailer on the hitch, with the sensor allowing retraction of an erected hitch only if no trailer is supported by the hitch.

Trailer hitches for use on intermodal railway cars are well known in the art. Typically, these trailer hitches are used on so-called "piggy back" intermodal railcars to secure over-the-road trailers on the railcar. In recent years, railroads have developed large terminals for handling intermodal shipments in which the trailers are lifted on and off the car either by means of a bridge crane straddling the track, or by means of large fork lifts or the like. In certain applications, to give shippers additional flexibility, such intermodal cars are designed to handle large containers as well as over-the-road trailers. So the railcar may have this dual use capability, it is necessary that the trailer hitch be retractable so as to not interfere with the container when the railcar is used to transport containers. Typically, these retractable hitches are moved from their lowered or retracted position to their erected or raised position through use of a manually operated screw jack mechanism or the like, or by using the crane to lift the retracted hitch.

As an alternative to lift on-lift off loading and unloading, so-called "circus train" intermodal railcars are known in which a tractor having a trailer hitched thereto drives in reverse lengthwise of one or a series of railcars. As the trailer is moved into a desired position, the tractor engages a retracted hitch, lifts it and locks it in its erect position, and effects transfer of the trailer from the tractor to the hitch. To offload a trailer, the trailer is transferred from the hitch to the tractor, after the tractor engages a bumper block on the hitch, so as to initiate retraction of the hitch. With the hitch retracted, the trailer may be driven off the railcar.

Typically, a retractable hitch includes a first or generally vertical strut and a second or diagonal strut. The upper ends of these struts are pivotally connected to a hitch head which serves as a fifth wheel for supporting the front end of the trailer and for positively holding the trailer on the railcar. The hitch head includes releasable jaws or the like for positively engaging the king pin of the trailer. The hitch is typically the only means for holding the trailer in place on the railcar when it is underway. At its destination, the hitch head is actuated so as to release the trailer kingpin, thereby to permit the trailer to be offloaded. Examples of prior art crane operated and tractor operated hitches, and of hitch heads, are shown in the following U.S. Pat. Nos.: 4,185,564, 4,193,350, 4,216,726, 4,221,397, 4,225,276, 4,230,430, 4,230,431, 4,239,429, 4,264,250, 4,397,594, 4,407,617, and 4,563,117.

Heretofore, a manually operable release mechanism has been provided on hitches so a train attendant or yard worker can release the hitch and cause it to retract. In order to do this on some hitches, the person had to be within close proximity to the hitch or the trailer. On many hitches, once the release mechanism is actuated, the hitch is free to fall, by gravity, to its retracted position. Because hitches are heavy, they tend to retract rapidly with great force. Of course, if the hitch is retracted while a trailer is still positioned on the railcar, the fifth wheel support provided by the hitch is no longer available. To avoid this, it would be advantageous to provide a hitch with a sensor which would permit hitch retraction only if a trailer was not supported by the hitch.

SUMMARY OF THE INVENTION

It is an object of the present invention to provide a sensor for a railcar hitch which senses the presence or absence of a trailer supported by the hitch so as to facilitate a safe operation of the hitch by a railyard worker.

Another object of the invention is to provide such a sensor which only permits retraction of a hitch if it senses the absence of a trailer and which positively prevents hitch retraction if the presence of a trailer is sensed.

Yet another object of the invention is to provide such a sensor which is installed on a hitch head in such a way as to not interfere with the normal operation of the hitch head to capture and release a trailer kingpin.

A further object of the invention is to provide such a sensor which operates by sensing the presence or absence of a trailer's kingpin assembly.

A still further object of the invention is to provide such a sensor which is adjustable.

Lastly, it is an object of the invention to provide a sensor having a sensing mechanism which is readily installed on the hitch and automatically operates as part of a normal hitch retraction operation.

Briefly, a trailer sensor of this invention is for use on a retractable railcar trailer hitch. The hitch has a hitch head for capturing a kingpin assembly of a trailer. The hitch is movable between a retracted and an erect position. The hitch has a locking mechanism for latching the hitch in its erect position and maintaining it there. A manually operable mechanism is provided for releasing the locking mechanism and allowing the hitch to retract. The sensor comprises a movable sensing element carried on the hitch head for sensing the presence or absence of a trailer. The sensing element moves in response to movement of the release mechanism. If a trailer is supported on the hitch, the presence of a trailer on the hitch blocks continued movement of the sensor and inhibits further operation of the release mechanism. This prevents retraction of the hitch. If no trailer is supported by the hitch, continued movement of the sensor element allows the release mechanism to unlock the hitch so it can retract. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
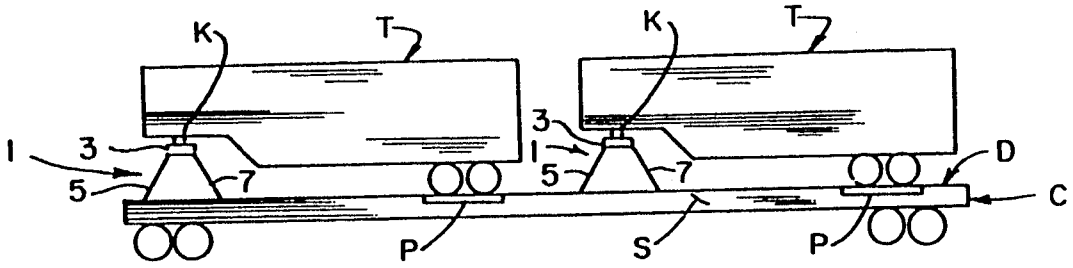
FIG. 1 is a representation of a spine-type intermodal railcar for transporting trailers and illustrates two hitches thereon incorporating the present invention.

Referring to the drawings, a retractable trailer hitch is indicated generally at 1. As shown in FIG. 1, hitch 1 is for use on an intermodal railroad car C of a type used to transport over-the-road trailers T. Car C may be a "spine" type railcar having an elongate center through sill or beam S extending lengthwise of the car and having an upper surface constituting a deck D. Car C is sufficiently long such that multiple (e.g., two) trailers T are transportable on the car, the front of each trailer being supported by a respective hitch 1. As shown in FIG. 1, only two trailers T are on car C. On opposite sides of the center through sill S, intermittent platforms P are provided for supporting the wheels of trailers T. As is well known in the art, trailers T are preferably hoisted onto car C so that their wheels rest on platforms P and so that the front of the trailer is supported on a respective hitch 1 However, it will be understood that the hitches 1 of the present invention may also be utilized with drive on-drive off intermodal railcars as well.

Hitches 1 are preferably erected prior to loading trailers on the car. The hitches have a hitch head 3 used to capture and hold a king-pin assembly K of the trailer and to support the front of the trailer during its transport. At its destination, the king-pin assembly is released and the trailers off-loaded. With respect to the erection of a railcar hitch, reference may be made to the co-assigned U.S. Patent 4,264,250 which is incorporated herein by reference. With respect to the design of hitch heads for capturing and holding the king-pin of a trailer, reference may be made to the following co-assigned U. S. Pat. Nos. 4,563,117, 4,397,594, 4,221,397, and 4,193,350 all of which are also incorporated herein by reference. It will be appreciated that the king-pin assembly includes a pin N captured in locking jaws (not shown) of the hitch head. The king-pin assembly further includes a relatively large diameter plate L which rests upon, or immediately above, the upper surface 4 of the hitch head.

Figure 2:
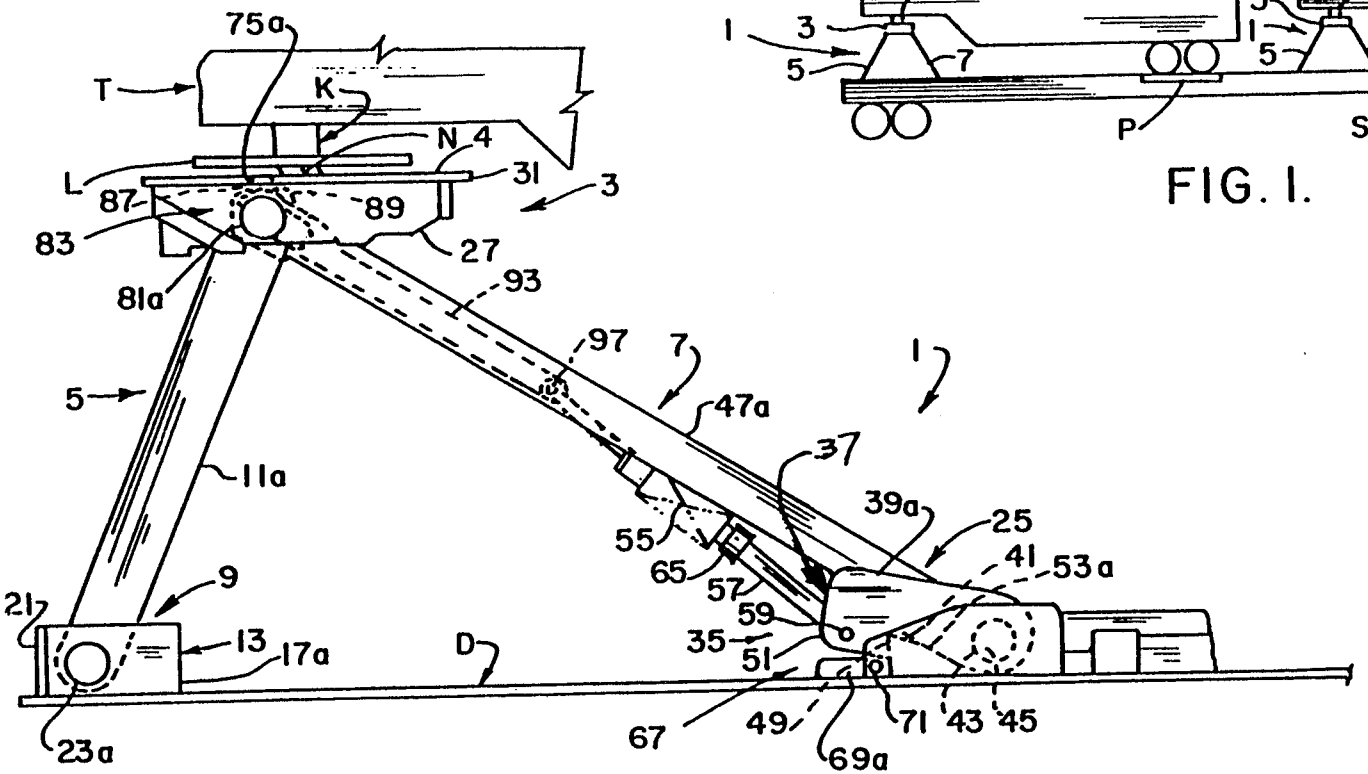
FIG. 2 is a partial side elevational view of the hitch in its erect or raised position.
Figure 3:
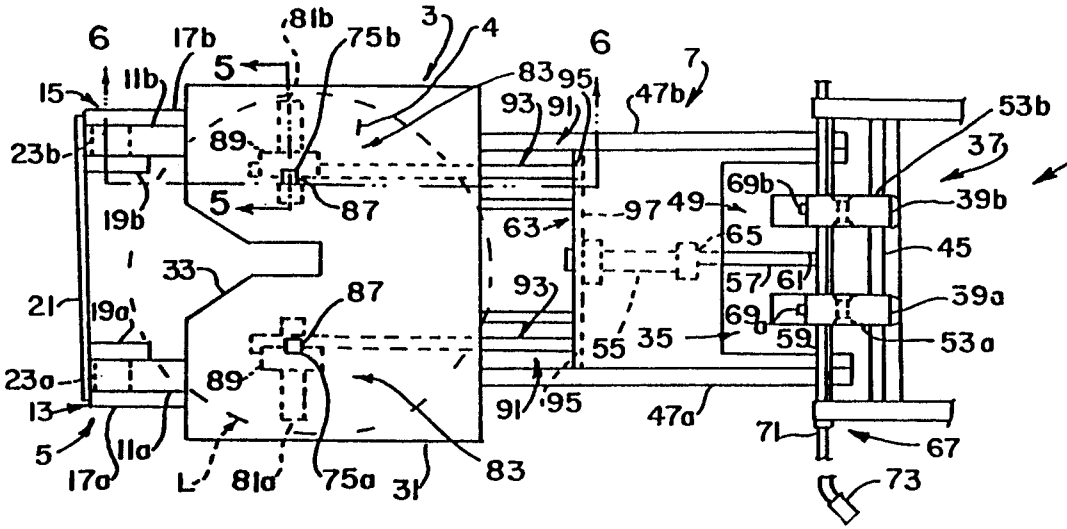
FIG. 3 is a partial top plan view of the hitch in its erect position.

Referring to FIGS. 2 and 3, hitch 1, whose components are axially aligned with the longitudinal centerline of car C, includes a first support strut 5 and a second support strut 7 for supporting hitch head 3. Strut 5 is a generally vertical strut when the hitch is erected, and one end 9 of the strut is pivotally mounted to deck D of the railcar. Strut 5 has a pair of parallel, spaced apart legs 11*a* and 11*b*. The respective ends of each leg are received in lug assemblies 13 and 15. The lug assemblies are attached to deck D and aligned so as to permit pivotal movement of strut 5 about an axis perpendicular to the longitudinal axis of the railcar as hitch 1 is moved between its erect and retracted positions. The lower end of each strut leg, which is received in its respective lug assembly 13 or 15, fits in a pocket formed by a sidewall 17*a*, 17*b*, respectively, and a bracket 19*a*, 19*b*, respectively, which extends rearwardly from and perpendicular to a front plate 21 of the lug assembly. A respective strut pin 23*a*, 23*b* extends through corresponding openings in the sidewall, strut leg, and bracket, to pivotally mount strut 5 to the deck so the strut can be raised and lowered.

Strut 7 is a diagonal strut, one end 25 of which is translatable in a horizontal direction over deck D. The strut is pivotal about a transverse, horizontal axis as it is translated longitudinally of the car between a hitch erect position and a hitch retracted position. As shown in FIG. 2, strut 5 is generally vertical (but leans somewhat toward diagonal strut 7) when the hitch is in its erect position. Strut 7 extends generally diagonally between the upper end of strut 5 and the deck when the hitch is erect.

Hitch head 3 is commonly pivotally carried on the respective opposite ends of struts 5 and 7, and is elevated above deck D when the hitch is erect. Since the hitch head structure is fully described in the above mentioned patents incorporated herein by reference and is commercially available from ACF Industries, Incorporated, the assignee of the present invention, under its trade designation Model 6, the construction of the hitch head will not be given in detail. The hitch head includes a head weldment 27 which is pivotally connected to the upper ends of struts 5 and 7 by pins (not shown). The weldment includes a top plate 31 whose top surface comprises upper surface 4 of the hitch head. The top plate has a notch 33 (see FIG. 3) extending rearwardly from the front of the weldment. The notch receives pin N of the king-pin assembly. Hitch head 3, as noted, has openable and closable jaws (not shown) which grip king-pin assembly K to hold trailer T in place during movement of the railcar. While not shown or described herein, it will be understood that the hitch head includes a king-pin release mechanism by which the jaws are opened.

Hitch 1 further includes a locking mechanism 35 for locking diagonal strut 7 and hitch 1 in the hitch erect position. Mechanism 35 includes a hook assembly 37 comprising a pair of latch plates 39*a* and 39*b*, respectively. The plates are identical in construction and each has a notch 41 extending upwardly from the base of the plate intermediate its length. At the rear of each plate is a transverse bore 43 for the plates to be mounted on a pin 45 which extends between legs 47*a*, 47*b* of strut 27. A latch lug 49 is mounted to the deck D of the railcar and has a base plate 51. A pair of upwardly extending, generally triangularly shaped latch members 53*a*, 53*b* are secured to the top of the base plate. The spacing of the members on the plate corresponds to that of latch plates 39*a*, 39*b*. The shape of the latch members corresponds generally to the shape of the notches 41 formed in plates 39*a*, 39*b*. The rear face of each latch member forms a ramp up which the leading edge of the respective plates are drawn as the hitch is erected. When forward movement of strut 7 pulls hook assembly 37 over base plate 51, the notches in the latch plates are captured by the respective latch members.

A compression spring 55 for biasing the hitch in its erected position is mounted on a bar 57. The lower end of this bar 57 (as shown in FIG. 2) is disposed between plates 53*a*, 53*b* of hook assembly 51. A pin 59 is inserted through a sleeve 61 at the lower end of bar 57 and the ends of pin 59 are received in plates 39*a*, 39*b*. The upper end of bar 57 is attached to a clevis assembly 63 which, in turn, is attached to legs 47*a*, 47*b* of strut 7. One end of the spring bears against the clevis assembly, while the other end of the spring bears against an annular seat 65 formed on the bar. The spring force is transmitted to the latch plates to urge the plates rearwardly and downwardly against the latch members This prevents unlocking of the hitch during service.

The hitch includes a manually operable mechanism 67 for retracting the hitch. The mechanism includes a pair of cams 69*a*, 69*b*, respectively, each of which is attached to a release rod 71. The rod extends transversely of the railcar and is pivotally mounted to the railcar deck. The length of the rod is such that the ends of the rod extend beyond the sides of the hitch. The ends of the rod are bent and terminate in sockets 73. A yardman standing on the track bed adjacent railcar C inserts a tool (not shown) in either socket 73 to rotate rod 71. Clockwise rotation of the rod moves cams 69*a*, 69*b* against the forward end of respective latch plates 39*a*, 39*b*. This lifts the latch plates off their respective latch members 53*a*, 53*b*. When the bottom edges of the latch plates clear the top of the latch members, retraction of the hitch commences.

Figure 5:
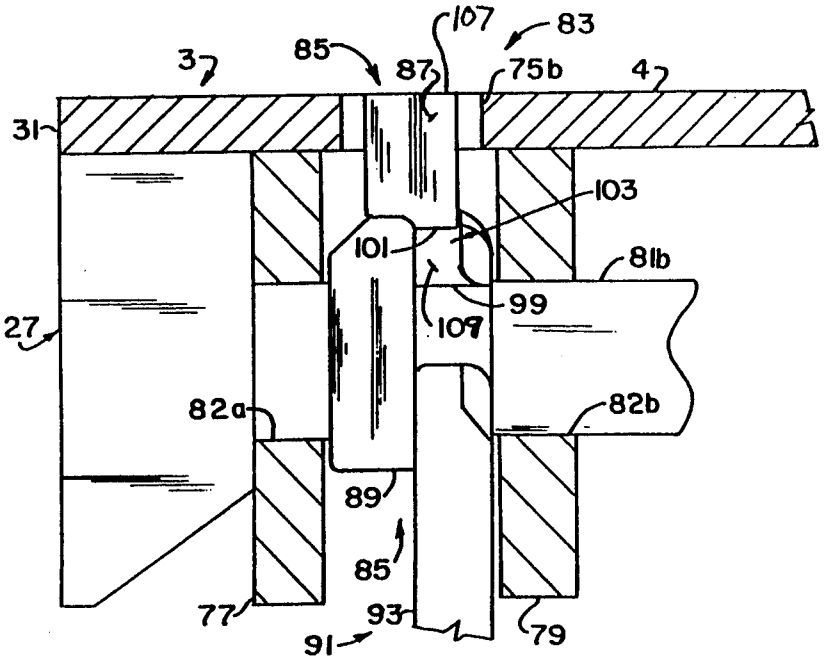
FIG. 5 is an enlarged scale sectional view taken along line 5—5 in FIG. 3.

To further protect the yardman, hitch 1 of the present invention is provided with a safety feature which only allows the hitch to be retracted if the presence of a trailer T is sensed on hitch 1 For this purpose, hitch head 3 has an opening 75*a*, 75*b* formed on opposite sides of the top plate 31. The openings which are square, or rectangular in shape, are equidistantly spaced from the longitudinal center line of the hitch head. As shown in FIG. 5, weldment 27, in addition to top plate 31, has a pair spaced apart, vertical plates 77, 79 (only one set of the plates are shown in FIG. 5) which depend from the underside of the plate. The openings 75*a*, 75*b* in the hitch head are located between these depending plates. Respective pins 81*a*, 81*b* extend transversely of the hitch head and are received in holes 82*a*, 82*b* in the respective sets of plates.

Figure 4:
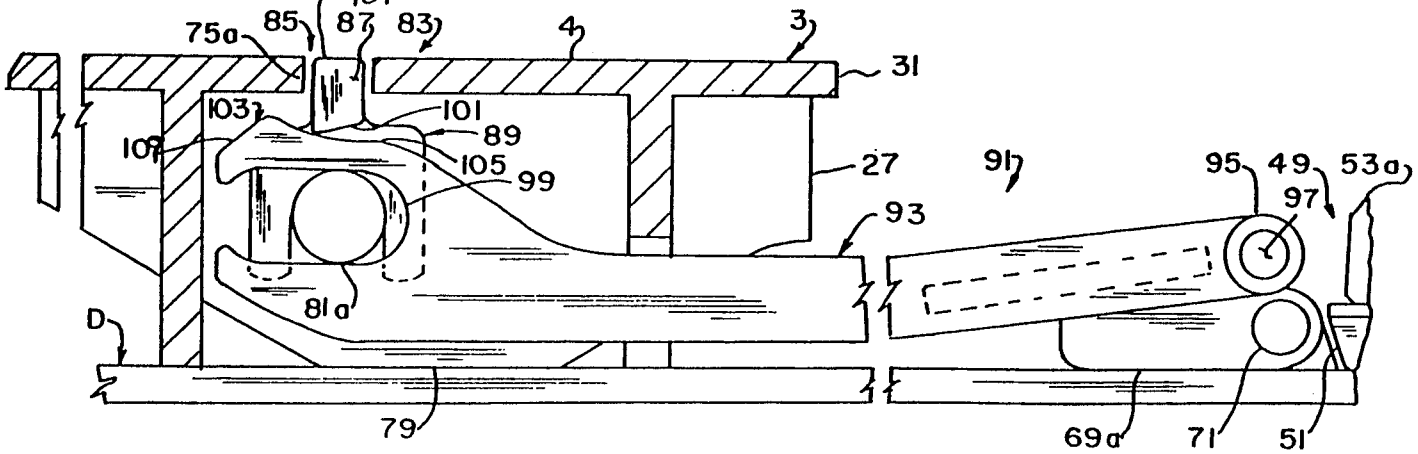
FIG. 4 is an enlarged scale partial sectional view of the hitch in its retracted position and illustrates the hitch head of the present invention.
Figure 6:
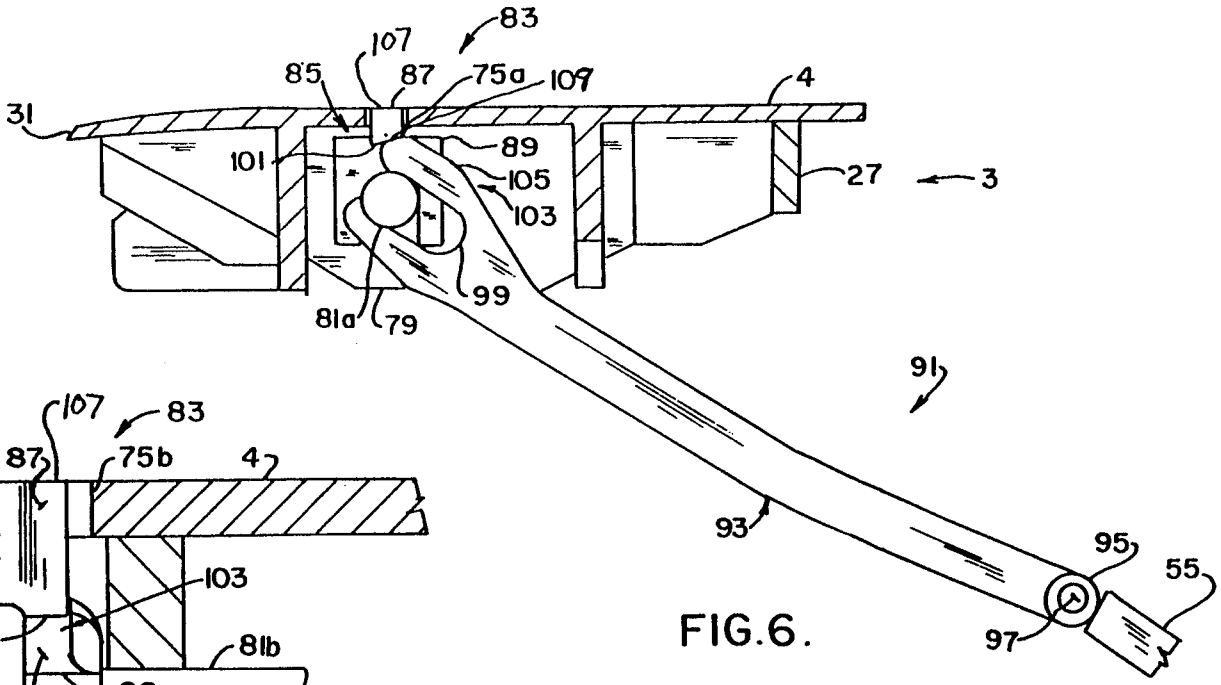
FIGS. 6 and 7 are sectional views taken along line 6—6 in FIG. 3, FIG. 6 illustrating the relationship between the components comprising the invention when the hitch is in its erect position, and FIG. 7 the relationship between the components when a manual release mechanism is actuated to retract the hitch.
Figure 7:
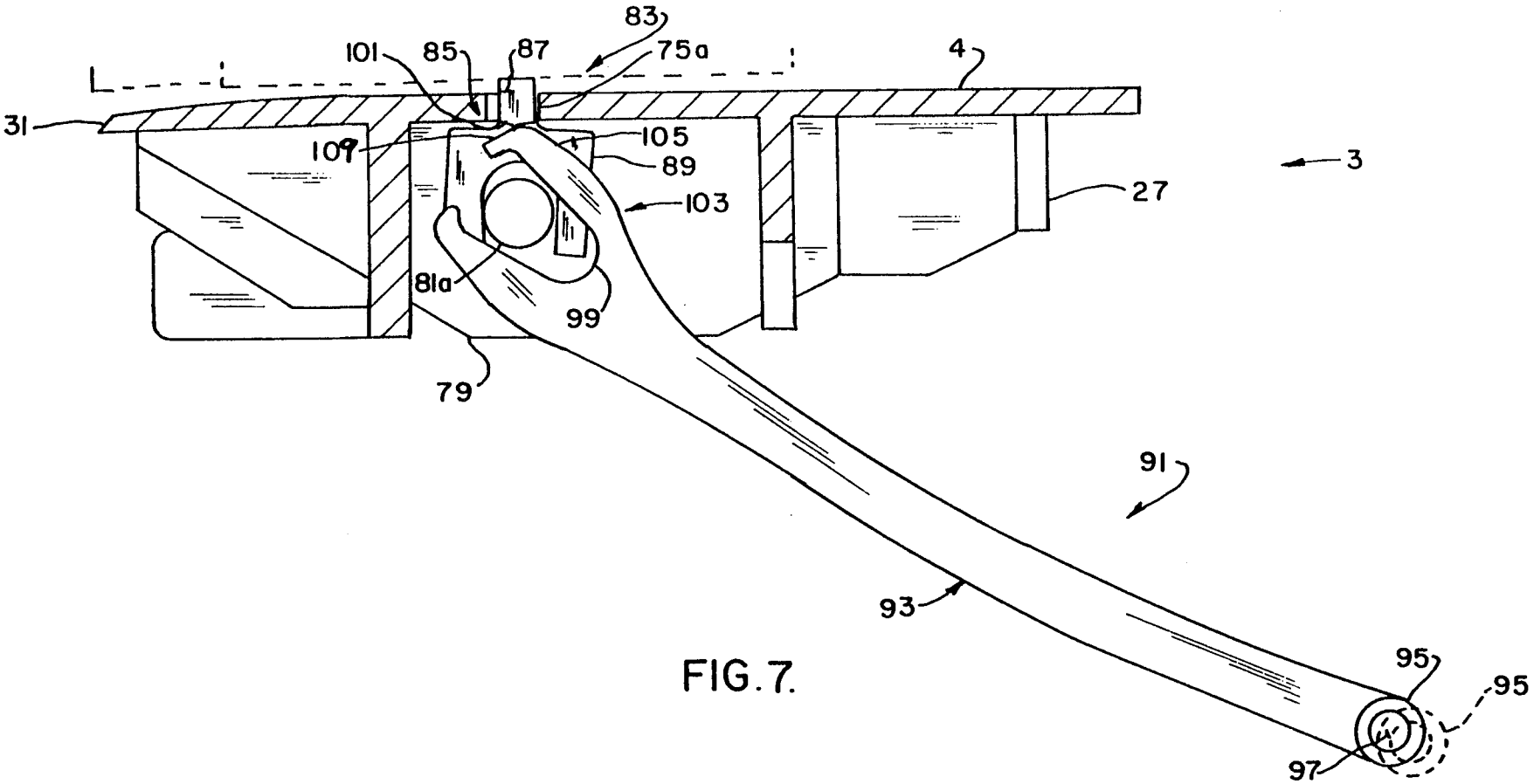

In accordance with the present invention, hitch 1 has a trailer sensor means, as generally indicated at 83, for detecting the presence of a trailer T supported on the hitch, and, if a trailer is supported by the hitch, for preventing retraction of the hitch. More particularly, trailer sensor means 83 of the present invention includes a pair of movable sensing elements, as generally indicated at 85, carried on the hitch head for detecting the presence or absence of a trailer. Each sensing element 85 includes a finger 87 integrally formed with a saddle 89 The saddle is U-shaped and straddles one of the pins 81*a*, 81*b*. Finger 87, which projects upwardly from the upper surface of its saddle 89, is sized to fit freely within its respective opening 75*a*, 75*b* in the hitch head and is received in the opening. As seen in FIGS. 4, 6 and 7, sensing fingers 87 are movable between a retracted position (as shown in FIGS. 4 and 6) when the hitch is in either its retracted or erect positions and an extended sensing position (see FIG. 7) for sensing the presence of a trailer upon initial movement of the hitch from its erect to its retracted position. Of course, if the presence of a trailer on the hitch is detected, means 83 serves to prevent the retraction of the hitch.

Sensor means 83 further includes means 91 for moving the sensing elements 85 from their retracted to their sensing positions, this means 91 comprising a pair of rods 93, each of which is associated with a respective sensing element. Each rod 93 extends parallel to one of the strut 7 legs 47*a*, 47*b* inboard of its closest strut leg. Each rod 93 carries a sleeve 95 on its lower end (see FIG. 6). A pin 97 extends transversely of strut 7 and is received in sleeves 95 to attach the rods 93 to strut 7. At the other end of each rod 93, a slot 99 is provided. The width of slots 99 corresponds to the diameter of respective pins 81*a*, 81*b*, which, as shown in FIGS. 4, 6 and 7 are received in slots 99. Further, the length of the slots 99 is sufficient to maintain the ends of the rods on the pins 81*a*, 81*b* as the hitch moves between its erect and retracted positions. Thus, as shown in FIG. 4, when the hitch is retracted, the pin is toward the inner end of the slot; while, when the hitch is erect, the pin is nearer the outer end of the slot.

Referring to FIG. 5, it is seen that finger 87 of each sensing element is offset with respect to saddle 89 so that the finger is to one side of the sensing element. Consequently, the lower end of the finger overhangs one side of the saddle. The bottom surface 101 of the overhanging portion of the finger rests upon the outer surface 103 of the upper end of each rod 93. Surface 103 is a cam surface having a first camming section 105 which bears against the bottomside of the finger when the hitch is retracted. As shown in FIG. 4, the contour of this cam section 105 is such as to maintain the upper surface 107 of finger 87 flush with the upper surface 4 of the hitch head when the hitch is retracted. Surface 103 has a second camming section 109 which bears against the underside of the finger when the hitch is erect. As seen in FIGS. 5 and 6, the contour of this camming section also serves to keep the outer face of the finger flush with the top surface of the hitch head. As the hitch is moved between its retracted and erect positions, rotation of the rods 93 produces a transition whereby this second camming surface bears against the bottom face of the finger.

Operation of the sensor is as follows: When the yard attendant wishes to retract hitch 1, he inserts a tool (e.g., a bar, not shown) in socket 73 of rod 71 and turns the rod in the clockwise direction, as seen in FIG. 2. This, in turn, causes clockwise rotation of cams 69*a* and 69*b*. The cams act on respective latch members 39*a*, 39*b* and to lift them off latch plates 53*a*, 53*b*. Clockwise movement of the latch plates causes strut 7 to move to the left as seen in the drawings, producing a consequent leftward movement of rods 93. Referring to FIG. 7, movement of rod 93 to the left causes the underside of finger 87 to ride up the camming surface of cam section 109. The upper end of the finger now protrudes above the upper surface of the hitch head. If a trailer is loaded on the railcar, its kingpin assembly K will be positioned on the hitch head regardless of whether the kingpin is captured by the jaws of the hitch head. The plate L of the kingpin assembly has a diameter sufficiently large so the plate covers a substantial portion of the hitch head and overlays one, if not both the openings 75*a*, 75*b* in the hitch head. Further, the distance between the underside of the plate and the top of the hitch is less than the distance the strut moves for the latch members to clear the latch plates. As a result, if a trailer is present, the upper face of one or both of the sensing element fingers 87 will strike the underside of plate L before the latch members clear the latch plates to initiate hitch retraction. The force exerted through rod 71 cams 69*a*, 69*b*, rods 93 and fingers 89 is insufficient to lift plate L. Consequently, initiation of hitch retraction is inhibited and the hitch remains in its elevated position.

If, on the other hand, there is no trailer present, fingers 89 senses its absence by not contacting any obstacle to continued movement of strut 7. Now, the latch members can be lifted clear of the latch plates and the hitch can be retracted.

What has been described is a trailer sensor by which the presence or absence of a trailer supported by the hitch can be sensed and the restriction of the hitch supporting the trailer can be prevented. Operation of the sensor is such that a hitch for holding the trailer on the car can be retracted only if no trailer is on the car. This prevents inadvertent retraction of the hitch and helps protect personnel working on or about the trailer, hitch and railcar.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A trailer sensor for use on a retractable railcar trailer hitch having a hitch head for capturing a kingpin assembly of a trailer, said kingpin assembly having a substantially horizontal assembly plate and a substantially vertical pin attached to the underside of said assembly plate said hitch head including a hitch head plate for contacting and supporting said trailer on said hitch head, a strut movable between a hitch retracted and a hitch erected position and carrying the hitch head thereon, a locking mechanism for latching the hitch in its erect position and maintaining it there, and a release mechanism for releasing the locking mechanism and allowing the hitch to retract, said sensor comprising:

a movable sensing element mounted on said hitch head for sensing the presence or absence of said trailer supported by said hitch head plate, said sensing element including means movable between a first raised position above said hitch head plate for contacting said assembly plate of said kingpin assembly of said trailer and vertically movable to a second lowered position by the weight of said trailer when said trailer is supported by said hitch head plate and when said assembly plate contacts said sensing element;

means responsive to operation of said release mechanism for moving said sensing element into contact with said trailer supported by said hitch; and means for inhibiting further operation of said release mechanism thereby preventing retraction of said hitch if said trailer is supported on said hitch, and, if said trailer is not supported by said hitch, allowing said release mechanism to unlock said hitch so it can retract.

2. The sensor of claim 1 wherein the sensor moving means includes rod means carried by said strut, said rod means being movable in response to initial movement of said locking mechanism from its locked position for moving said sensing element into engagement with said trailer supported by said hitch.

3. The sensor of claim 2 wherein said hitch head plate has an opening therethrough, and wherein said sensing element includes a finger movable within said opening to contact said trailer supported by said hitch.

4. The sensor of claim 3 wherein said hitch head includes a pin located on the underside thereof, and wherein said sensing element includes a saddle seated on the pin with said finger projecting upwardly from said saddle through said opening.

5. The sensor of claim 4 wherein said rod means has a lower end responsive to movement of said locking mechanism from its locked position, said rod means further having a slot in which said pin is received.

6. The sensor of claim 5 wherein the length of said slot is such as to accommodate movement of said rod means as said hitch moves between its erect and retracted positions.

7. The sensor of claim 5 wherein said finger extends beyond one side of said saddle, and wherein the upper end of said rod means has a camming surface contacting the bottomside of said finger for effecting movement of said finger into engagement with said trailer.

8. The sensor of claim 7 wherein said camming surface has a first cam section contacting said finger when the hitch is retracted such that the upper end of said finger is clear of a trailer supported on said hitch head, and a second cam section contacting finger when the hitch is erect so as to move said finger toward said trailer supported on said hitch head when said locking mechanism is operated to release said hitch.

9. The sensor of claim 3 wherein said hitch head plate has a second opening therethrough on the opposite side of said hitch head from said first opening, wherein said sensor includes a second sensing element having a second finger movable within said second opening, and wherein said rod means includes a second rod for moving said second finger.

10. The sensor of claim 2 further including means for adjusting the position of said rod means relative to the strut.

11. In a retractable railcar trailer hitch having a hitch head for capturing a kingpin assembly of a trailer supported by said hitch, said hitch head including a plate for supporting said trailer on said hitch, said late having an opening therein and said hitch head further including a pin located on the underside thereof, a strut movable between a hitch retracted and a hitch erected position and carrying said hitch head thereon, means for locking said hitch in its erect position, and means for releasing said locking means thereby to permit retraction of said hitch, wherein the improvement comprises: means for sensing the presence or absence of said trailer supported by said hitch, said sensing means including a sensing element carried on said hitch head and comprising a finger movable through said opening to contact said trailer, and means responsive to the operation of said locking means for moving said finger into contact with said trailer supported by the hitch, if said trailer is supported by said hitch, and for blocking further operation of said locking means thereby preventing retraction of the hitch, and, if no trailer is supported by the hitch, for allowing operation of said locking means to permit retraction of said hitch, wherein said sensing means further includes rod means carried by the strut, said rod means being movable in response to initial movement of said locking means for effecting movement of said finer to sense the presence of a trailer supported by said hitch, said sensing means still further including a saddle seated on said pin with said finger projecting upwardly from the saddle through said opening, wherein said rod means has a lower end for movement in response to movement of said locking means toward its unlocked position and an upper end having a slot in which the pin is received, said slot accommodating movement of said rod means as said hitch moves between its erect and retracted positions.

12. The improvement of claim 11 wherein the upper end of said rod means has a cam surface cammingly engageable with said finger to move said finger for sensing the presence of said finger on said hitch.

13. The improvement of claim 12 wherein said cam surface has a first cam section permitting said finger to be clear of a trailer supported on said hitch when the hitch is erect and when said locking means is locked, and a second cam section cammingly engagable with said finger when the hitch is erect, for moving said finger toward sensing engagement with a trailer supported by said hitch when locking means is operated to unlock said hitch.

14. The improvement of claim 11 wherein the plate has a second opening in the top thereof on the opposite side thereof from said first opening, wherein said sensing means includes a second finger positioned in this second opening, and wherein said rod means further comprises a second rod for moving said second element.

15. A trailer sensor for use on a retractable railcar trailer hitch having a hitch head for capturing a kingpin assembly of a trailer, said hitch head including a plate for contacting and supporting said trailer on said hitch head, the plate having an opening therethrough, and the hitch head further including a pin located on the underside thereof, a strut movable between a hitch retracted and a hitch erected position and carrying the hitch head thereon, a locking mechanism for latching the hitch into erect position and maintaining it there, and a release mechanism for releasing the locking mechanism and allowing the hitch to retract, said sensor comprising:

a movable sensing element mounted on said hitch head for sensing the presence or absence of said trailer supported by said plate, said sensing element including means movable between a first raised position above said plate for contacting said trailer and vertically movable to a second lowered position when said trailer is supported by said plate;

means responsive to operation of said release mechanism for moving said sensing element into contact with said trailer supported by said hitch means including rod means carried by said strut, said rod means being movable in response to initial movement of said locking mechanism from it locked position for moving said sensing element into engagement with said trailer supported by said hitch; and, means for inhibiting further operation of said release mechanism thereby preventing retraction of said hitch if said trailer is supported on said hitch, and, if said trailer is not supported by said hitch, allowing said release mechanism to unlock said hitch so it can retract, said inhibiting means including a finer movable within said opening to contact said trailer supported by said hitch, and a saddle seated on said pin with said finger projecting upwardly from said saddle through said opening, said rod means having a lower end responsive to movement of said locking mechanism from its locked position, and a slot in which said pin is received.

* * * * *